US009532593B2

(12) United States Patent
Turner

(10) Patent No.: US 9,532,593 B2
(45) Date of Patent: Jan. 3, 2017

(54) HERBAL SMOKING BLEND

(71) Applicant: John Turner, Encino, CA (US)

(72) Inventor: John Turner, Encino, CA (US)

( * ) Notice: Subject to any disclaimer, the term of this patent is extended or adjusted under 35 U.S.C. 154(b) by 300 days.

(21) Appl. No.: 14/141,339

(22) Filed: Dec. 26, 2013

(65) Prior Publication Data

US 2015/0181925 A1 Jul. 2, 2015

(51) Int. Cl.

| | |
|---|---|
| ***A24B 15/16*** | (2006.01) |
| ***A24B 15/30*** | (2006.01) |
| ***A24B 15/42*** | (2006.01) |

(52) U.S. Cl.

CPC ..... *A24B 15/42* (2013.01); *A24B 15/16* (2013.01); *A24B 15/303* (2013.01)

(58) Field of Classification Search

USPC ..... 131/290, 200, 309, 310, 347, 352

See application file for complete search history.

(56) References Cited

U.S. PATENT DOCUMENTS

| | | | | |
|---|---|---|---|---|
| 6,845,771 | B1 | 1/2005 | Love | |
| 7,325,548 | B2 * | 2/2008 | Enslin | A24B 15/28 131/347 |
| 2004/0103908 | A1 | 6/2004 | Prakash et al. | |
| 2009/0035396 | A1 | 2/2009 | De Meijer | |
| 2011/0174323 | A1 * | 7/2011 | Coleman, III | A24B 15/24 131/298 |
| 2014/0287068 | A1 * | 9/2014 | Lewis | A01H 1/04 424/725 |
| 2015/0136158 | A1 * | 5/2015 | Stevens | A24F 47/008 131/329 |

FOREIGN PATENT DOCUMENTS

| | | | |
|---|---|---|---|
| GB | 2 449 691 | A | 12/2008 |
| WO | WO 01/66089 | A2 | 9/2001 |

OTHER PUBLICATIONS

Choi et al., "Inhalation delivery of proteins from ethanol suspensions", *Division of Health Sciences and Technology*, vol. 98, No. 20, pp. 11103-11107; Sep. 25, 2001.

Gardner, "Terpenoids, 'minor' cannabinoids contribute to 'entourage effect' of cannabis-based medicines", *O'Shaughnessy's The Journal of Cannabis in Clinical Practice*; pp. 18-22; Autumn 2011.

McPartland, "Advantages of polypharmaceutical herbal *Cannabis* compared to single-ingredient, synthetic tetrahydrocannabinol", *Bioresource Hemp* 2000, Wolfsburg; 13 pages; Sep. 2000.

(Continued)

*Primary Examiner* — Dennis Cordray

(74) *Attorney, Agent, or Firm* — Knobbe, Martens, Olson & Bear LLP

(57) ABSTRACT

The disclosed embodiments relate generally to herbal smoking blends and methods for preparing and using herbal smoking blends, and relate more particularly to herbal smoking blends having terpenoids added thereto. In one aspect, a method of preparing an herbal smoking blend comprises providing a smoking herb preparation. The method additionally comprises providing a terpenoid solution comprising a terpenoid. The terpenoid solution may be added to the smoking herb preparation to, for example, provide a smoking herb preparation that achieves a desired effect on a consumer of the preparation.

27 Claims, 4 Drawing Sheets

(56) References Cited

OTHER PUBLICATIONS

McPartland et al., "Cannabis and Cannabis Extracts: Greater than the sum of their parts?", *The Haworth Press, Inc.*, pp. 103-132; 2001.

Russo, "Taming THC: potential cannabis synergy and phytocannabinoid-terpenoid entourage effects", *British Journal of Pharmacology: Themed Issue: Cannabinoids in Biology and Medicine, Part I*, vol. 163, pp. 1344-1364; 2011.

* cited by examiner

HERBAL SMOKING BLEND

BACKGROUND

Field

The disclosed embodiments relate generally to herbal smoking blends and methods for preparing and using herbal smoking blends, and more particularly to herbal smoking blends having terpenoids added thereto.

Description of the Related Art

The smoking of various herbs can provide physiological and/or psychological effects, some of which can provide therapeutic benefits. For example, *cannabis*, also known as marijuana, is an herb that can be smoked for recreational purposes or therapeutic purposes, such as to treat nausea, pain, muscle spasticity, and loss of appetite, among other conditions. It has been observed that different herbs, including different species, different strains, or different varieties of an herb can have different therapeutic effects. Consequently, different species, strains, or varieties of herbs have been cultivated to achieve desired effects. Such cultivation, however, can be time-consuming, can limit the availability herbs with a desired effect, and may be cost-prohibitive for rare or difficult to cultivate plants.

Accordingly, there is a continuing need for methods of providing smoking herbs with desired effects.

SUMMARY

In one aspect, a method of preparing an herbal smoking blend comprises providing a smoking herb preparation. The method additionally comprises providing a terpenoid solution comprising a terpenoid. The terpenoid solution is added to the smoking herb preparation.

In another aspect, a smoking herb preparation system comprises a smoking herb. The system additionally comprises a terpenoid solution comprising at least one terpenoid. The system further comprises an applicator for administering a dose of the terpenoid solution to the smoking herb.

In another aspect, an herbal smoking blend comprises a smoking herb and a terpenoid at a terpenoid concentration, where the terpenoid is not naturally occurring in the smoking herb at the terpenoid concentration. In some embodiments, examples of a terpenoid include a terpenoid is selected from the group consisting of d-limonene, α-pinene, β-myrcene, linalool, pulegone, 1,8-cineole (eucalyptol), α-terpineol, terpineol-4-ol, p-cymene, borneol, Δ-3-carene, β-caryophyllene, caryophyllene oxide, nerolidol, phytol, Eugenol, Sabinene, Linalyl Acetate, Camphor, Chamazulene, beta-Farnesene, alpha-Humulene, Benzyl Benzoate, Benzyl Acetate, Geraniol, Geranyl Acetate, gamma-Terpinene, beta-Pinene, and combinations thereof, wherein the terpenoid is not naturally occurring in the smoking herb at the terpenoid concentration in the smoking herb blend. In some embodiments, the terpenoid is not naturally produced by smoking herb plant.

DETAILED DESCRIPTION

Figure 1:
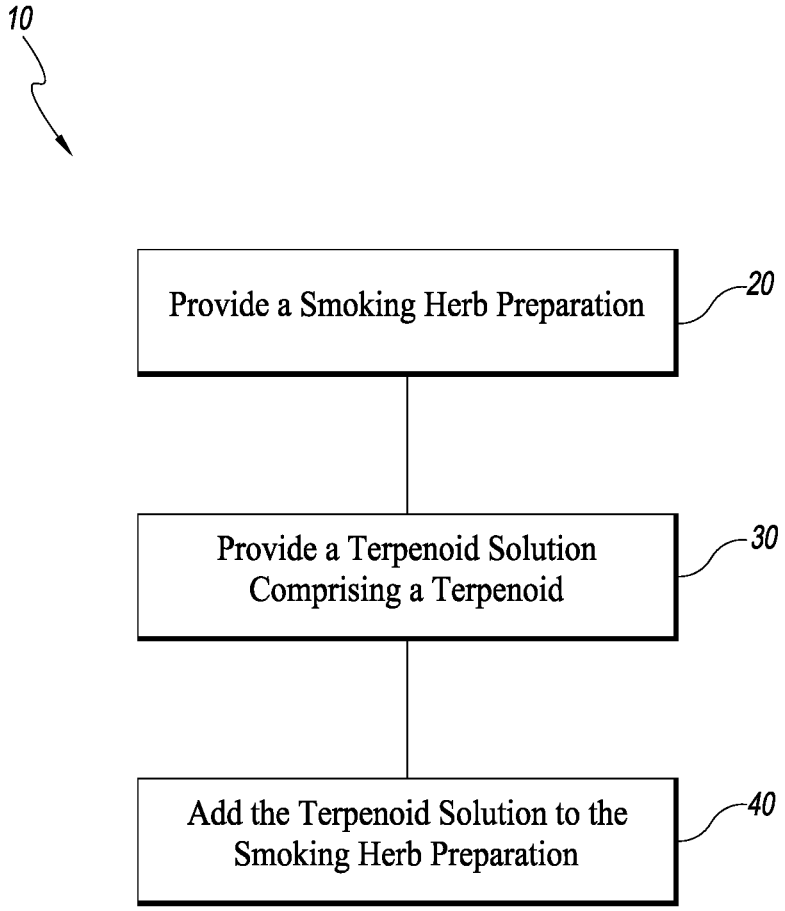
FIG. 1 is a flow chart illustrating a method of preparing an herbal smoking blend, according to some embodiments.

Since the discovery of therapeutic effects of inhaled smoke of *cannabis*, the chemical origins of the therapeutic effects have been an intense area of research. The primary focus of the research into the chemical origins of the therapeutic effects of *cannabis* has been centered around a class of active compounds called *cannabis* phytocannabinoids. Phytocannabinoids, also referred to as cannabinoids, refer to a group of $C_{21}$ terpenophenolic compounds that are uniquely produced in *cannabis*. The most widely known phytocannabinoid is tetrahydrocannabidol (THC), which is known to be responsible for producing psychoactivity commonly associated with *cannabis*. Since the isolation of THC, other phytocannabinoids have been isolated and some have been associated with therapeutic effects. While over 100 phytocannabinoids are known to exist, a group of well-documented phytocannabinoids include tetrahydrocannabidol (THC), cannabidiol (CBD), cannabichromene (CBC), cannabigerol (CBG), tetrandrocannabivarin (THCV), cannabidivarin (CBDV) and cannabinol (CBN). Some of the therapeutic effects of phytocannabinoids include, without being bound to any theory, euphoric effects (associated, for example, with THC and THCV), analgesic effects (associated, for example, with THC, CBD and THCV), sedative effects (associated, for example, with CBD), antipsychotic effects (associated, for example, with CBD), anti-inflammatory effects (associated, for example, with THC, CBD, CBC, CBG and CBN), anti-convulsant effects (associated, for example, with CBD and CBN), anti-biotic effects (associated, for example, with CBC, CBN and CBG), and anti-fungal effects (associated, for example, with CBC and CBG), to name a few. Under certain circumstances, there may be synergistic enhancement of certain therapeutic effects in naturally occurring *cannabis* when certain amounts and/or ratios of phytocannabinoids are present in combination. For example, an overall enhancement in therapeutic effects of *cannabis* may be achieved when a certain balance is struck between THC and CBD. For example, sedative effects of CBD may serve to oppose certain undesirable effects of THC, such as anxiety, thereby enhancing the overall therapeutic effects.

Other isolated compounds of *cannabis* may have certain therapeutic effects when inhaled as part of *cannabis* smoke, including terpenoids, flavonoids, and phytosterol. Terpenoids are derived from repeating units of isoprene ($C_5H_8$), such as monoterpenoids (with $C_{10}$ skeletons), sesquiterpenoids ($C_{15}$), diterpenoids ($C_{20}$), and triterpenoids ($C_{30}$). The final structure of terpenoids can range from simple linear chains to complex molecules and may simply be a hydrocarbon, or may include alcohol, ether, aldehyde, ketone, or ester functional groups attached to a carbon skeleton. As used herein, the term terpenoids include terpenes. Over 200 naturally occurring terpenoids have been identified and isolated from *cannabis*. Such terpenoids include d-limonene, α-pinene, β-myrcene, linalool, pulegone, 1,8-cineole (eucalyptol), α-terpineol, terpineol-4-ol, p-cymene, borneol, Δ-3-carene, β-caryophyllene, caryophyllene oxide, nerolidol, and phytol. Some of the therapeutic effects of terpenoids include, without being bound to any theory, analgesic effects (associated, for example, with β-myrcene), sedative effects (associated, for example, with linalool, pulegone and α-terpineol), antidepressant effects (associated, for example, with linalool and d-limonene), anti-inflammatory effects (associated, for example, with β-myrcene, β-caryophyllene, 1,8-cineole, α-pinene and Δ-3-carene), anti-mutagenic effects (associated, for example, with β-myrcene and d-limonene), anti-biotic effects (associated, for example, with β-myrcene, 1,8-cineole, p-cymene, terpineol-4-ol, borneol and α-pinene), and Acetylcholinesterase (AChE) inhibitor effects (associated, for example, with pulegone, p-cymene, terpineol-4-ol and α-terpineol), to name a few. It will be appreciated that, under certain circumstances, there may be synergistic enhancement of certain therapeutic effects in naturally occurring *cannabis* when certain amounts and/or ratios of terpenoids are present in combination.

In addition, under certain circumstances, when phytocannabinoids and terpenoids are simultaneously present in *cannabis*, there may also be cross-compound synergistic effects. That is, the therapeutic effects obtained from *cannabis* having certain combinations of some phytocannabinoids and some terpenoids is greater than the sum of therapeutic effects obtained from the phytocannabinoids or the terpenoids taken alone. For example, without being bound to any theory, analgesic effects of THC may be synergistically boosted by various terpenoids, anticonvulsant effects of CBD and THCV may be synergistically boosted by linalool, anti-inflammatory/antifungal effects of CBC and CBG may be synergistically boosted by caryophyllene oxide, anti-inflammatory/analgesic effects of CBC may be synergistically boosted by various terpenoids, sedative effects of CBN may be synergistically boosted by β-myrcene and nerolidol, to name just few examples of synergistic effects when phytocannabinoids and terpenoids are inhaled together as part of *cannabis* smoke.

Naturally occurring therapeutic compounds in *cannabis*, including phytocannabinoids and terpenoids, are synthesized in secretory cells inside glandular trichomes of *cannabis*. In addition, different strains of *cannabis* produce and can be bred to produce varying amounts of certain compounds. For example, common "street" *cannabis* may have been bred such that relatively high amounts of THC are present to maximize the "high" of the person using the *cannabis* for recreational purposes. The same strain of "street" *cannabis*, however, may not have been bred to maximize, and therefore contain less than desired amounts of terpenoids or phytocannabinoids other than THC. As a result, while the effect of such *cannabis* strain as a euphoriant may be relatively high, their therapeutic effects may be relatively low. Therefore, to improve the therapeutic effects and to target certain therapeutic effects from *cannabis*, attempts to cultivate different strains of *cannabis* having particular combinations and amounts of specific phytocannabinoids and terpenoids have been made. However, such effort has been time consuming and not necessarily aimed at mass cultivation to serve the general public.

While some terpenoids naturally occur in *cannabis*, terpenoids also naturally occur in plants other than *cannabis*. As with *cannabis*, terpenoids in some plants give rise to the distinctive odor of the plants. For example, d-limonene occurs naturally in citrus plants, and is the predominant compound that gives rise to the familiar scent of citrus. Similarly, α-pinene occurs naturally in coniferous plants and is the predominant compound that gives rise to the familiar scent of pine. Thus, some terpenoids, such as d-limonene and α-pinene, occur relatively abundantly.

It has been found that the therapeutic effects of smoking herbs may be tailored by varying the terpenoid composition of the smoking herbs. In some embodiments the smoking herb may be *cannabis* and the therapeutic effects may include synergistic effects between the phytocannabinoids that are naturally present in a particular strain of *cannabis* and terpenoids that may be isolated from plants other than the particular strain of *cannabis* or other than *cannabis* in general. The terpenoids may be added to a preparation made from the particular strain of *cannabis* and may provide a terpenoid concentration that is just as high, if not higher, than terpenoid levels that are naturally occurring in, for example, other *cannabis* strains. Thus, in some embodiments, the terpenoid added to the smoking herb preparation may be at a higher concentration than that naturally found in the smoking herb or the terpenoid may not be naturally produced by the smoking herb plant at all.

It will be appreciated that adding desired types and amounts of terpenoids from plants other than the particular strain *cannabis* can offer several advantages. For example, terpenoids from other plants can be economically favorable compared to, for example, breeding particular strains of *cannabis* having similar types and amounts of terpenoids. In addition, the desired types and amounts can be targeted more specifically to enhance or magnify known therapeutic effects, or even create new therapeutic effects that may not be possible using natural or engineered strains of *cannabis* alone.

Reference will now be made to the drawings, in which like numerals refer to like parts throughout.

FIG. 1 is a flow chart illustrating a method 10 of preparing an herbal smoking blend, according to some embodiments. The method of preparing an herbal smoking blend comprises providing 20 a smoking herb preparation. The method additionally includes providing 30 a terpenoid solution comprising a terpenoid. The method further includes adding 40 the terpenoid solution to the smoking herb preparation.

In some embodiments, providing 20 the smoking herb preparation includes providing a smoking herb including smoking *cannabis*, including any species, subspecies, strain or variety of *cannabis*. The herb preparation can include any part of the plant of the *cannabis*, including the leaf, the root, the stem, the flower, or any other part of the plant that occurs naturally. In some embodiments, the smoking herb includes *cannabis* plants cultivated for fiber and seed production, sometimes described as low-intoxicant, non-drug, or fiber types. In some other embodiments, the smoking herb includes *cannabis* plants cultivated for drug production, sometimes described as high-intoxicant or drug types. In some other embodiments, the smoking herb includes *cannabis* plants that are escaped, hybridized, or wild forms of either of the above types.

In some embodiments, a preparation includes smoking herb that has been sufficiently dried so that it can be combusted under ordinary ambient conditions, such that the resulting smoke can be inhaled. In some embodiments, a preparation includes a smoking herb and a rolling paper that can be used to roll the smoking herb into a thin cylinder using a rolling paper, similar to a cigarette.

In other embodiments, providing 20 the smoking herb preparation can include providing a smoking herb other than *cannabis*. Examples of other smoking herbs include *amaranthus dubius, arctostaphylos uva-ursi, argemone mexicana, arnica, artemisia vulgaris, calea zacatechichi, canavalia maritima, cecropia mexicana, cestrum nocturnum, cynoglossum virginianum, cytisus scoparius, entada rheedii, eschscholzia californica, fittonia albivenis, hippobroma longiflora, humulus japonica, humulus lupulus, lactuca virosa, laggera alata, leonotis leonurus, leonurus cardiaca, leonurus sibiricus, lobelia cardinalis, lobelia inflata, lobelia siphilitica, nepeta cataria, nicotiana* (i.e., tobacco),

*nymphaea alba, opium poppy, passiflora incarnata, pedicularis densiflora, pedicularis groenlandica, salvia divinorum, salvia dorrii, salvia, scutellaria galericulata, scutellaria lateriflora, scutellaria nana, scutellaria, sida acuta, sida rhombifolia, silene capensis, syzygium aromaticum, tagetes lucida, tarchonanthus camphoratus, turnera diffusa, verbascum*, and *zornia latifolia*, to name a few.

In some embodiments, providing 20 the smoking herb preparation comprises providing a smoking herb comprising at least one phytocannabinoid, such as a phytocannabinoid selected from the group consisting of delta-9-tetrahydrocannabinol (THC), cannabidiol (CBD), cannabichromene (CBC), cannabigerol (CBG), tetrahydrocannabivarin (THCV), cannabidivarin (SBDV) and cannabinol (CBN).

In some embodiments, providing 20 the smoking herb preparation comprises providing a smoking herb other than *cannabis*. In some embodiments, for example where a synergistic effect between a phytocannabinoid and terpenoids is desired, the smoking herb other than *cannabis* may comprise at least one added phytocannabinoid, such as a phytocannabinoid selected from the group consisting of delta-9-tetrahydrocannabinol (THC), cannabidiol (CBD), cannabichromene (CBC), cannabigerol (CBG), tetrandrocannabivarin (THCV), cannabidivarin (SBDV) and cannabinol (CBN).

Still referring to FIG. 1 the illustrated method of method 10 of preparing an herbal smoking blend additionally includes providing 30 a terpenoid solution comprising a terpenoid. As used herein, a terpenoid solution refers to a mixture comprising a terpenoid and a solvent, where at least a portion of the terpenoid is incorporated in the mixture to form the terpenoid solution. The terpenoid can be miscible, immiscible, or partially miscible in the solvent. In embodiments where the terpenoid is at least partially immiscible, the resulting mixture is sometimes referred to as an emulsion.

In some embodiments, providing 30 the terpenoid solution includes providing a solution including a terpenoid selected from the group consisting of d-limonene, α-pinene, β-myrcene, linalool, pulegone, 1,8-cineole (eucalyptol), α-terpineol, terpineol-4-ol, p-cymene, borneol, Δ-3-carene, β-caryophyllene, caryophyllene oxide, nerolidol, phytol, Eugenol, Sabinene, Linalyl Acetate, Camphor, Chamazulene, beta-Farnesene, alpha-Humulene, Benzyl Benzoate, Benzyl Acetate, Geraniol, Geranyl Acetate, gamma-Terpinene, beta-Pinene, and combinations thereof.

In some embodiments, providing 30 the terpenoid solution comprises providing a terpenoid and a solvent, and mixing the terpenoid and the solvent. The solvent can include any liquid, e.g., a volatile liquid, which can incorporate a desired amount of the terpenoid in the terpenoid solution. As used herein, a liquid that incorporates the terpenoid includes a liquid that can hold the terpenoid in either dissolved form or undissolved form (e.g., suspended in the form of an emulsion). In some embodiments, a terpenoid solution having a terpenoid incorporated therein can be a solution having at least 0.1% terpenoid by volume at room temperature and atmospheric pressure.

In some embodiments, the solvent comprises an alcohol, e.g., ethanol, and water. In some embodiments, the terpenoid solution comprises about 1% to about 5% by volume of the terpenoid, about 40% to about 90% by volume of ethanol and about 10% to about 55% by volume of water. In some embodiments, the terpenoid solution comprises about 2% to about 4% by volume of the terpenoid, about 66% to about 80% by volume of ethanol and about 20% to about 30% by volume of water. Advantageously, such a solution can allow the terpenoid to be evenly distributed or suspended in the solvent, thereby facilitating the formation of a homogenous solution that allows a desire quantity of terpenoid to be added to a smoking herb preparation.

Still referring to FIG. 1, in some embodiments, the terpenoid in the terpenoid solution can be in a substantially purified form including a targeted terpenoid selected from the group consisting of d-limonene, α-pinene, β-myrcene, linalool, pulegone, 1,8-cineole (eucalyptol), α-terpineol, terpineol-4-ol, p-cymene, borneol, Δ-3-carene, β-caryophyllene, caryophyllene oxide, nerolidol, phytol, and combinations thereof. As used herein, a substantially purified terpenoid refers to the terpenoid being free of impurities other than the targeted terpenoids, with a volume percent of the impurities not exceeding about 5%, about 1%, or about 0.1%. For example, if a substantially pure terpenoid includes a first terpenoid (e.g., d-limonene) and a second terpenoid (e.g. α-pinene) as targeted terpenoids, any other substance including other terpenoids (e.g., β-myrcene, linalool, etc.) would be considered impurities.

As described above, terpenoids can naturally originate from *cannabis* or other plants. In some embodiments, the terpenoid in the terpenoid solution does not naturally occur in the herb or herbs forming the smoking herb preparation. In some embodiments where the smoking herb preparation includes *cannabis*, providing 30 the terpenoid solution includes providing a solution including a terpenoid that is derived from a plant other than *cannabis* in general. In some other embodiments where the smoking herb preparation includes *cannabis*, providing 30 the terpenoid solution includes providing a solution including a terpenoid that is derived from a plant other than the *cannabis* strain from which the smoking herb has been prepared.

In some embodiments, the terpenoid in the terpenoid solution can be provided in the form of an essential oil. An essential oil, sometimes referred to as a volatile oil, an ethereal oil, or an athereola, refers to a concentrated liquid extracted from a plant that can contain, among other compounds, terpenoids. Compounds such as terpenoids included in essential oil often carry a distinctive scent, or essence (hence the name).

In some embodiments, the essential oils can be prepared using one of several methods including, without limitation, distillation, expression and solvent extraction, among others. In distillation, raw plant material, which can include the flowers, leaves, wood, bark, roots, seeds, and/or peel, is put into a distillation apparatus over water. The water is then heated above the boiling point to generate steam therefrom, which passes through the plant material. As the stem passes through the plant material, the volatile compounds are vaporized. The vapors may flow through a coil, where they condense back to liquid, which is then collected in a receiving vessel. In expression, the raw plant material is expressed mechanically or cold-pressed. Expression can be a suitable method where the raw material is available in relatively large quantities at relatively lower cost, such as orange peels for producing citrus-fruit oils. In solvent extraction, a solvent such as hexane or supercritical carbon dioxide is used to extract the oils. Solvent extraction can be a suitable method where the raw material is available in relatively small quantities at relatively higher cost, such as flowers. Solvent extraction can also be a suitable method where the chemical components are too delicate and easily denatured by the high heat used in steam distillation.

A non-exhaustive list of plant species from which essential oils can be extracted to provide a terpenoid in the method 10 of FIG. 1 include: *Abies Alba, Abies Balsamea, Abies*

*Sibirica, Achillea Millefolium, Achillea Millefolium Ligustica, Acorus Calamus, Agathophyllum Anisata, Agathophyllum Aromatica, Agathosma Betulina, Agathosma Crenulata, Allium Cepa, Allium Sativum, Aloysia Triphylla, Alpinia Galanga* (L.) Sw., *Alutinosum Druce, Ammi Visnaga, Amyris Balsamifera, Anethum Graveolens, Angelica Archangelica, Angelica Glauca, Aniba Rosaeodora* Var. *Amazonica, Anthemis Nobilis, Anthopogon Rhododendron* D. *Don, Apium Graveolens, Aquilaria Malaccensis, Artemisia Absinthium, Artemisia Afra, Artemisia Annua, Artemisia Dracunculus, Artemisia Pallens, Artemisia Vulgaris, Backhousia Citriodora, Boswellia Carteri, Boswellia Carterii, Boswellia Neglecta, Boswellia Serrata, Bulnesia Sarmienti, Callitris Intratropica, Cananga Odorata, Cananga Odorata Genuina, Cananga Odorata Macrophylla, Canarium Luzonicum, Carum Carvi, Cedrelopsis Grevei, Cedrus Atlantica, Cedrus Deodara, Chamaecyparis Callitropsis Nootkatensis, Chamaecyparis Lawsoniana, Chamaecyparis Obtusa* Endl., *Chamaemelum Nobile* (*Anthemis Nobilis*), *Cinnamomum Camphora, Cinnamomum Camphora* L, *Cinnamomum Cassia, Cinnamomum Glaucescens, Cinnamomum Polyandrum, Cinnamomum Zeylanicum, Cinnamosma Fragrans, Cistus Ladaniferus, Citrus Aurantifolia, Citrus Aurantium, Citrus Aurantium* Var. *Amara, Citrus Bergamia, Citrus Bergamia Risso, Citrus Clementine, Citrus Hystrix, Citrus Junos, Citrus Junos Siebold, Citrus Limonum, Citrus Paradisi, Citrus Reticulata, Citrus Sinensis, Citrus Tangerina, Coleonema Album, Commiphora Holtziana, Commiphora Myrrha, Copaifera Officinalis, Coriandrum Sativum, Cotinus Coggygria, Croton Eluteria, Cryptocarya Massoia, Cuminum Cyminum, Cupressus Rotundus, Cupressus Sempervirens, Curcuma Longa, Cymbopogon Citratus, Cymbopogon Flexuosus, Cymbopogon Flexuosus* Stapf, *Cymbopogon Martini* Var. *Martinii* (Var. *Motia*), *Cymbopogon Nardus, Cymbopogon Winterianus Jewitt, Cymbopogon Winterianus Jowitt, Cympobogan Martini* Type Sofia, *Cyperus Scariosus, Daucus Carota, Elettaria Cardamomum Maton, Eremophila Mitchellii, Eriocephalus Africanus, Eriocephalus Punctulatus, Eucalyptus Citriodora, Eucalyptus Citriodora Hook., Eucalyptus Dives, Eucalyptus Globulus, Eucalyptus Polybractea, Eucalyptus Radiata, Eucalyptus Smithii, Eugenia Caryophyllata, Ferula Galbaniflua, Foeniculum Vulgare Mill* Var *Dulce, Foeniculum Vulgare* Mill., *Fokienia Hodginsil, Gaultheria Procumbens, Geranium Macrorrhizum, Helichrysum Gymnocephalum, Helichrysum Italicum, Helichrysum Stoechas, Hippophae Rhamnoides, Humulus Lupulus, Hydicum Spicatum, Hypericum Perforatum* L, *Hyssopus Officinalis, Illicium Verum, Juniperus Communis, Juniperus Communis* L., *Juniperus Oxycedrus, Juniperus Virginiana, Kaempferia Galanga* L, *Kunzea Ericoides, Lantana Camera, Laurus Nobilis, Lavandula Hybrida, Lavandula Latifolia, Lavandula Officinalis, Leptospermum Petersonii, Leptospermum Scoparium, Levisticum Officinalis, Lippia Citriodora, Lippia Javanica, Litsea Cubeba, Marjorana Hortensis, Matricaria Chamomilla, Matricaria Recutita, Matricaria Recutita, Melaleuca Alternifolia, Melaleuca Minor, Melaleuca Quinquenervia, Melaleuca Viridiflora, Melissa Officinalis, Mentha Arvensis, Mentha Citrata, Mentha Piperita, Mentha Pulegium, Mentha Spicata, Michelia Alba*, Mix Of 4 Species, *Monarda Fistulosa* L., *Murraya Koenigii, Myristica Fragrans, Myrocarpus Fastigiatus, Myroxylon Pereirae, Myrtus Communis, Myrtus Communis, Nardostachys Grandiflora, Nardostachys Jatamansi, Nepeta Cataria, Ocimum Basilicum, Ocimum Basilicum* L., *Ocimum Basillicum, Ocimum Sanctum, Ocotea Cymbarum, Oleum Abies Sibirica, Oleum Chamomille, Oleum Pinus Nigra, Oreganum Vulgare, Origanum Compactum Benth., Origanum Minutiflorum, Origanum Syriacum, Origanum Vulgare, Ormenis Mixta, Pandanus Odoratissimus, Pelargonium Graveolens, Pelargonium× Asperum, Perilla Frutescens Crispa, Petroselinum Crispum, Petroselinum Sativum, Picea Mariana, Pimenta Dioica* (*Pimenta Officinalis*), *Pimenta Officinalis, Pimenta Racemosa, Pimpinella Anisum, Pimpinella Anisum* L., *Pinus Pinaster, Pinus Pumilio, Pinus Sylvestris, Piper Cubeba, Piper Nigrum, Pistacia Lentiscus, Pogostemon Cablin, Prunus Amygdalus, Pseudotsuga Menziesii* (Mirb.) *Franco, Psiadia Altissima, Rhus Tarantana, Rosmarinus Officinalis, Ruta Graveolens, Salvia Lavandulifolia, Salvia Officinalis, Salvia Sclarea, Salvia Stenophylla, Santalum Album, Santalum Spicatum, Santolina Chamaecyparissus, Satureja Hortensis, Satureja Montana, Schinus Molle, Tagetes Bipinata* L, *Tagetes Minuta, Tanacetum Annuum Linnaeus, Tarchonanthus Camphoratus, Thuja Occidentalis, Thuja Orientalis, Thuja Plicata, Thujopsis Dolabrata, Thymbra Spicata, Thymus Capitatus, Thymus Mastichina, Thymus Satureioides, Thymus Serpillum, Thymus Vulgare, Thymus Vulgaris, Thymus Zygis, Trachyspermum Ammi, Tsuga Canadensi, Valeriana Officinalis, Vetivera Zizanioides, Vitex Agnus-Castus* L, *Vitis Vinifera, Xanthoxylum Armatum, Zanthoxylum Armatum* Dc. (*Rutaceae*), *Zingiber Cassumunar, Zingiber Officinale*, and *Zinziber Officinale*, among others.

In some embodiments, examples of the the essential oil mixture includes mixtures that comprise at least one essential oil extracted from the group of plants consisting of *Salvia Sclarea, Pimenta Racemosa, Pistacia Lentiscus, Citrus Limonum* or a combination thereof. In some embodiments, the essential oil mixture consists essentially of *Salvia Sclarea* and *Pimenta Racemosa*. In some of other embodiments, the essential oil mixture consists essentially of *Salvia Sclarea* and *Pistacia Lentiscus*. In yet other embodiments, the essential oil mixture consists essentially of *Pistacia Lentiscus* and *Citrus Limonum.*

In some other embodiments, the essential oil mixture comprises first and second essential oils extracted from the group of plants consisting of *Salvia Sclarea, Pimenta Racemosa, Pistacia Lentiscus*, or *Citrus Limonum*, wherein a volume ratio between first and second essential oils is between about 0.01:1 and about 1:1. In some other embodiments, the volume ratio is between about 0.10:1 and about 1:1, or between about 0.50:1 and about 1:1, for instance about 1:1.

Still referring to FIG. 1, the illustrated method 10 of preparing an herbal smoking blend further includes adding 40 the terpenoid solution to the smoking herb preparation. The terpenoid solution can be added using a suitable method for incorporating at least a portion of the terpenoid in the terpenoid solution into the smoking herb preparation.

In some embodiments, adding 40 the terpenoid solution comprises dropping the terpenoid solution on the smoking herb. As used herein, adding the terpenoid solution by dropping refers to delivering a volume of liquid using, for example, a dropper, to deliver the liquid. In some embodiments, the dropper may deliver the liquid in an amount of between about 5-100 drops per mL, depending on, among other things, the viscosity of the terpenoid solution and the type of dropper used.

In other embodiments, adding 40 the terpenoid solution comprises spraying a mist (or droplets) of the terpenoid solution on the smoking herb. As used herein, adding the terpenoid solution by spraying refers to delivering fine drops of the terpenoid solution dispersed in a gas by using, for example, a spray nozzle or atomizer, to deliver the terpenoid solution. The spray characteristics, including the spray pattern, the spray capacity, and the spray drop size depend on, among other things, the viscosity of the terpenoid solution and the type of spray nozzle used. In yet other embodiments, adding the terpenoid solution comprises spraying using an aerosol spray which includes the terpenoid solution.

In some embodiments, adding 40 the terpenoid solution comprises dipping, or at least partially immersing the smoking herb into the terpenoid solution. By way of an example, the smoking herb can be placed in a dip net or a similar device and lowered into a container containing the terpenoid solution. In some embodiments, a soaking time can be tailored to control the amount of terpenoid solution that is absorbed, impregnated, or incorporated into the smoking herb. In some embodiments, the soaking time is between about 1 second and about 1 day, or between about 10 seconds and about 1 hour, or between about 1 minute and about 10 minutes. The smoking herb can be subsequently dried in air, or by heating the smoking herb, for example at a temperature below a temperature at which the smoking herb ignites.

In some other embodiments, the smoking herb preparation comprises a smoking herb and a rolling paper. In these embodiments, adding 40 the terpenoid solution comprises adding the terpenoid solution to the rolling paper, which can subsequently be used to roll the smoking herb. The terpenoid can be added to the rolling paper using a suitable method to impregnate the rolling paper with the terpenoid solution. For example, the rolling paper can be dipped in a bath of terpenoid solution. Other methods include dropping or spraying the terpenoid solution on the rolling paper. For example, in some embodiments, the terpenoid can be added to a pre-rolled cigarette containing smoking herbs.

It will also be appreciated that the terpenoid solution can be added to the smoking herb by more than one method, for example, by two or more of the methods disclosed herein. For example, the terpenoid solution can be added to the smoking herb by dipping and drying the smoking herb preparation, and subsequently by providing drops of the terpenoid solution to the smoking herb or rolling paper for the smoking herb. In some embodiments, this can increase the concentrations of terpenoids (e.g., volatile terpenoids) in the preparation. In some other embodiments, different terpenoids solutions are added to the smoking herb preparation at different times. For example, a solution with relatively less volatile terpenoids may be added to the smoking herb concentration initially (e.g., hours before consumption, or from a manufacturer or supplier) and a solution with relatively more volatile terpenoids may be added to the smoking herb preparation immediately (e.g., minutes) before smoking.

In some embodiments where the smoking herb preparation includes *cannabis*, the amount of terpenoid added to the smoking herb preparation exceeds the amount of *cannabis* terpenoid that was present in the smoking herb prior to adding the terpenoid solution to the smoking herb preparation. In some embodiments, the amount of terpenoid added to the smoking herb preparation exceeds the amount of *cannabis* terpenoid that was present in the smoking herb prior to adding the terpenoid solution to the smoking herb preparation, such that the overall amount of terpenoid increases by more than about 50%, by about 100%, or by about 1000%.

In some embodiments, the amount of added terpenoid exceeds about 0.001% by weight of the smoking blend, about 0.01% by weight of the smoking blend, or about 0.05% by weight.

In some embodiments, the method 10 of preparing an herbal smoking blend further comprises subjecting the smoking herb preparation to a drying process after adding the terpenoid solution.

Figure 2:
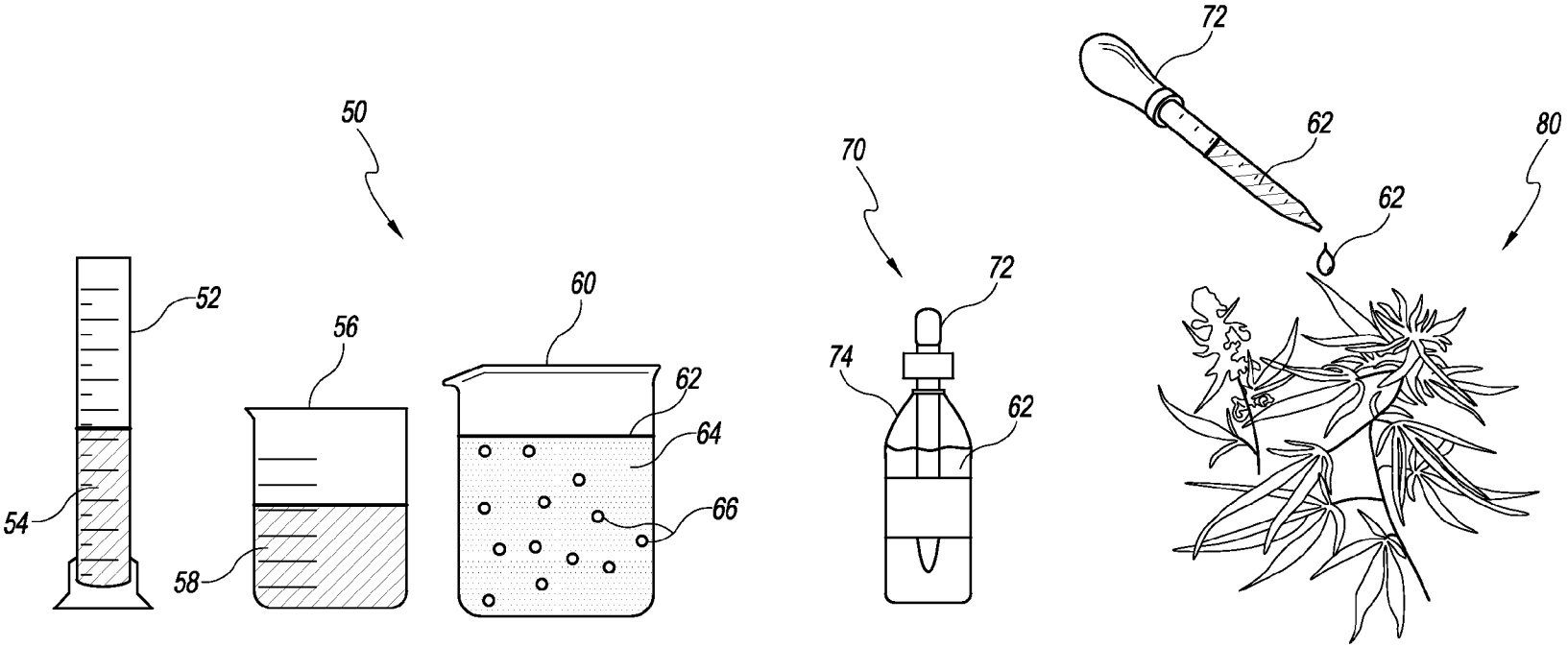
FIG. 2 is a schematic illustration of a smoking herb preparation system comprising a smoking herb, according to some embodiments.

FIG. 2 is a schematic illustration of a smoking herb preparation system comprising according to some embodiments. The smoking herb preparation system comprises a smoking herb 80 and a terpenoid solution application kit 70.

In some embodiments, the terpenoid solution application kit 70 comprises a terpenoid solution 62, a terpenoid solution container 74 for holding the terpenoid solution, and a terpenoid solution applicator 72 for administering a dose of the terpenoid solution to the smoking herb.

Still referring to FIG. 2, in some embodiments, the terpenoid solution 62 can be prepared by using a terpenoid solution preparation system 50. The terpenoid preparation system includes a terpenoid measurement device 52, a terpenoid mixture 54 comprising at least one terpenoid, a solvent measurement device 56, a solvent 58, and a terpenoid solution mixing container 60. The terpenoid measurement device 52 can be any suitable container for measuring and mixing terpenoids to form the terpenoid mixture 54, such as a beaker, a graduated cylinder, a measuring cup, and the like. In some embodiments, the terpenoid mixture 54 includes one or more terpenoids, such as terpenoids selected from the group consisting of d-limonene, α-pinene, β-myrcene, linalool, pulegone, 1,8-cineole (eucalyptol), α-terpineol, terpineol-4-ol, p-cymene, borneol, Δ-3-carene, β-caryophyllene, caryophyllene oxide, nerolidol, phytol, and combinations thereof. In some other embodiments, the terpenoid mixture 54 includes an essential oil mixture extracted from the group of plants consisting of *Salvia Sclarea, Pimenta Racemosa, Pistacia Lentiscus, Citrus Limonum*, and combinations thereof. The solvent measurement device 56 can be any suitable container for measuring and mixing different solvent components to form the solvent 58, such as a beaker, a graduated cylinder, a measuring cup, and the like. The solvent 58 can include any liquid, e.g., a volatile liquid, which can incorporate a desired amount of the terpenoid in the terpenoid solution. In some embodiments, the solvent components include ethanol and water, in proportions described above.

In some embodiments, the terpenoid solution 62 is formed by mixing the terpenoid mixture 54 and the solvent 58 in the terpenoid solution mixing container 60. The terpenoid solution 62 includes the terpenoid mixture 54 incorporated into the solvent 58. In some embodiments, at least a portion of the terpenoid mixture 54 is miscible in the solvent 58 and can be dissolved in the solvent 58 to form the terpenoid solution 62. In other embodiments, at least a portion of the terpenoid mixture 54 is immiscible in the solvent 58 and can be suspended in the solvent 58 to form the terpenoid solution 62. The terpenoid solution 62 can then be transferred into the terpenoid solution container 74 of the terpenoid solution application kit 70.

Still referring to FIG. 2, the terpenoid solution application kit 70 comprises any suitable terpenoid solution applicator 72 for administering a dose of the terpenoid solution 62 to the smoking herb 80. In some embodiments, the applicator comprises a dropper having a bulb member and a pipette member. The dropper can have any suitable design for forming suitable drops as discussed above for application on the smoking herb 80. For example, the dropper member may have a bulb made of elastic material configured to fill the pipette member with the terpenoid solution 62 thorough a vacuum suction effect. In some embodiments, the dropper may have a threaded closure to enable long term storage of the terpenoid solution. In some embodiments, the pipette member can be graduated to guide a user to administer a predetermined dose of the terpenoid solution on the smoking herb 80. In some other embodiments, the applicator 72 may deliver a stream of the terpenoid solution to the smoking herb 80, rather than delivering drops. In some other embodiments, the dropper may be integrated into the container 74 itself, which may provide drops directly from an opening in the container 74. For example, the container 74 may be dropper bottle and the dropper section may be the drop generating opening of the bottle.

Figure 3:
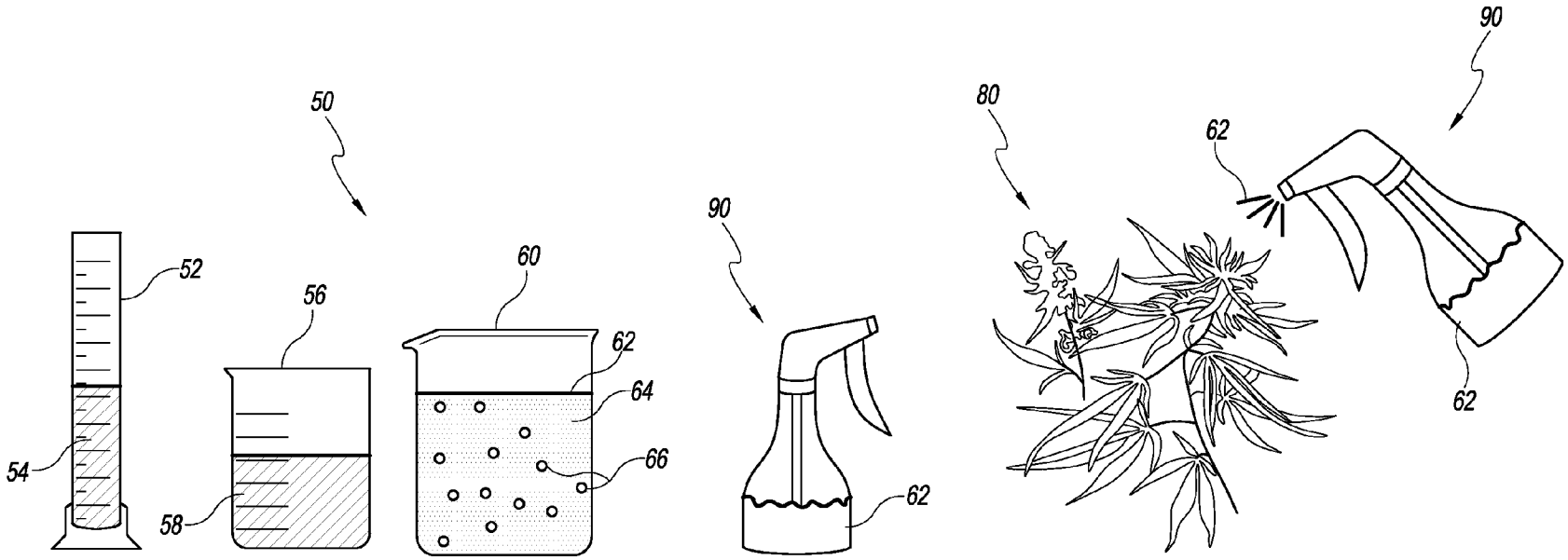
FIG. 3 is a schematic illustration of a smoking herb preparation system comprising a smoking herb, according to some other embodiments.

FIG. 3 is a schematic illustration of a smoking herb preparation system comprising a smoking herb according to some embodiments. The smoking herb preparation system comprises a smoking herb 80 and a terpenoid solution application kit 90. The smoking herb preparation system of FIG. 3 is similar to the smoking herb preparation system of FIG. 2 except for the terpenoid solution application kit 90. The terpenoid solution application kit 90 comprises a terpenoid solution 62, a terpenoid solution container 94 for holding the terpenoid solution, and a terpenoid solution applicator 92 for administering a dose of the terpenoid solution to the smoking herb. The terpenoid solution container 94 can be, for example, a plastic spray bottle made of plastic, or other terpenoid solution reservoir in fluid communication with a nozzle for dispensing the terpenoid solution, such as an atomizer that dispenses the terpenoid solution as mist or spray. The terpenoid solution 62 can be mixed in the terpenoid solution container 94 and dispensed, for example through the terpenoid solution applicator 92, which can be a trigger sprayer, mounted on the terpenoid solution container. In some embodiments, the trigger sprayer may have a threaded closure to enable long term storage of the terpenoid solution. In some embodiments, the trigger sprayer can be configured to administer a predetermined dose of the terpenoid solution on the smoking herb 80. The trigger sprayer 92 can also be configured to determine other spray characteristics such as droplet volume, spray angle, etc.

Figure 4:
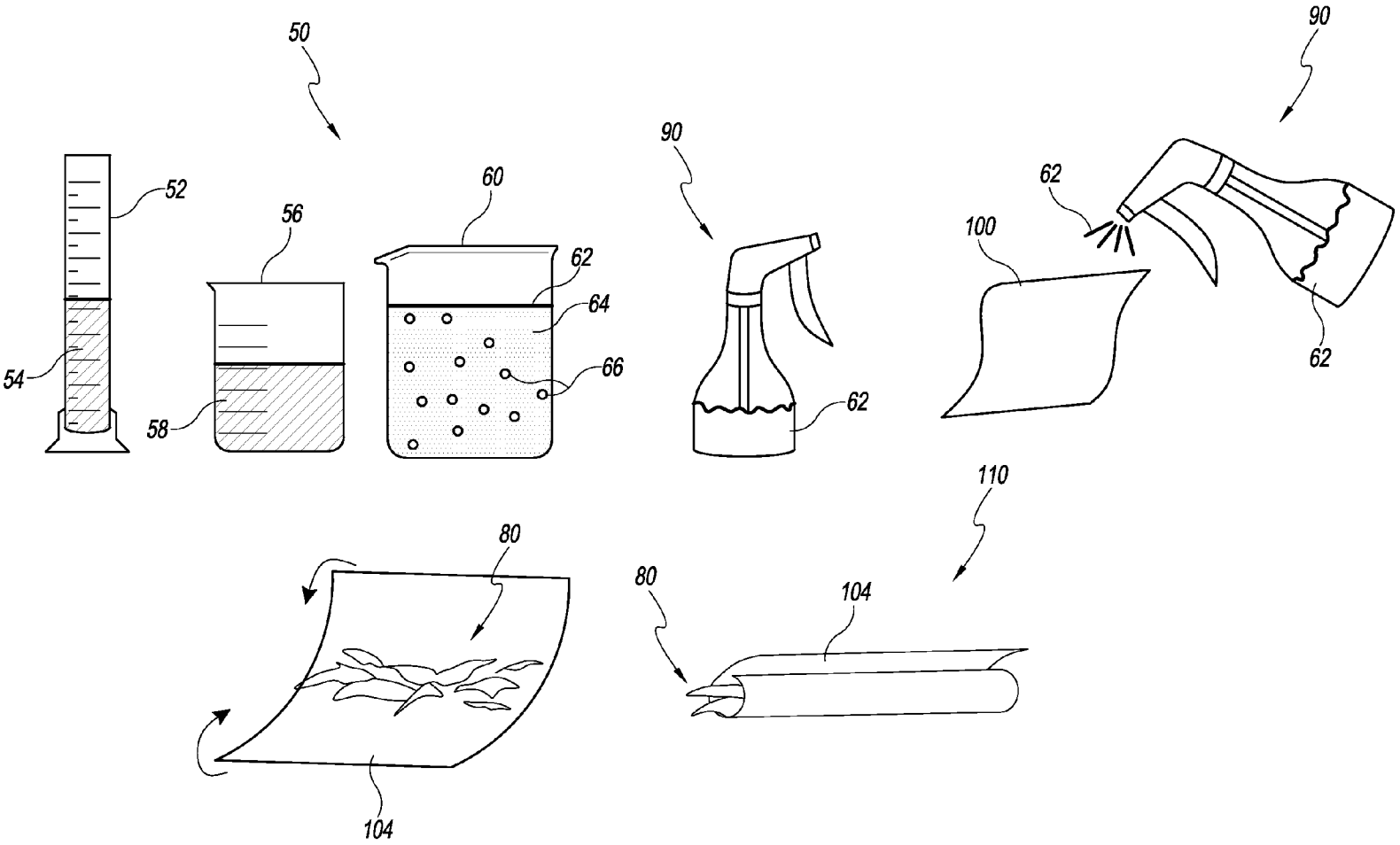
FIG. 4 is a schematic illustration of a smoking herb preparation system comprising a smoking herb, according to yet other embodiments.

FIG. 4 is a schematic illustration of a smoking herb preparation system comprising a smoking herb according to some embodiments. The smoking herb preparation system comprises a smoking herb 80 and a terpenoid solution application kit 90. While the smoking herb preparation system of FIG. 4 includes terpenoid solution application kit 90 is similar to FIG. 3, a terpenoid solution application kit similar to the terpenoid solution application kit 70 of FIG. 4, or any other similar application kits can be used. In addition, the smoking herb preparation system of FIG. 4 further includes a rolling sheet 100. Unlike FIG. 2 or FIG. 3, instead of incorporating the terpenoid solution directly into the smoking herb 80, the smoking herb preparation system of FIG. 4 is configured such that the terpenoid solution can be incorporated into the rolling sheet 100 instead of, or in addition to, incorporating the terpenoid solution into the smoking herb 80 using the suitable terpenoid application kit 90. In these embodiments, the resulting terpenoid rolling sheet 104 can be subsequently dried and used to roll the smoking herb 80 into a thin cylinder 110 having the smoking herb 80 rolled therein, in a similar manner to a rolled cigarette. In some embodiments, the rolling sheet 100 can be a paper made from wood pulp. In other embodiments, the rolling sheet 100 can be made from rice or other plant matter such as hemp. In some other embodiments, the rolling sheet can be a pre-formed wrapper (e.g., a cylindrical wrapper) for holding the smoking herb 80.

Although this invention has been described in terms of certain embodiments, other embodiments that are apparent to those of ordinary skill in the art, including embodiments that do not provide all of the features and advantages set forth herein, are also within the scope of this invention. Moreover, the various embodiments described above can be combined to provide further embodiments. In addition, certain features shown in the context of one embodiment can be incorporated into other embodiments as well. Accordingly, the scope of the present invention is defined only by reference to the appended claims.

What is claimed is:

1. A method of preparing an herbal smoking blend, comprising:

providing a smoking herb preparation comprising *cannabis;* providing a terpenoid solution comprising a terpenoid; and adding the terpenoid solution to the smoking herb preparation, wherein the terpenoid is selected from the group consisting of pulegone, terpineol-4-ol, p-cymene, borneol, eugenol, sabinene, linalyl acetate, chamazulene, beta-farnesene, benzyl benzoate, benzyl acetate, geraniol, geranyl acetate and combinations thereof.

2. The method of claim 1, wherein the terpenoid is not naturally occurring in the herb preparation.

3. The method of claim 1, wherein the terpenoid solution comprises an essential oil mixture.

4. The method of claim 3, wherein the essential oil mixture comprises at least one essential oil extracted from the group of plants consisting of *Salvia Sclarea, Pimenta Racemosa, Pistacia Lentiscus, Citrus Limonum* or a combination thereof.

5. The method of claim 3, wherein the essential oil mixture comprises first and second essential oils extracted from the group of plants consisting of *Salvia Sclarea, Pimenta Racemosa, Pistacia Lentiscus*, or *Citrus Limonum*, and wherein a volume ratio between first and second essential oils is between about 0.01:1 and about 1:1.

6. The method of claim 3, wherein the terpenoid solution further comprises a solvent, wherein the solvent comprises ethanol and water.

7. The method of claim 3, wherein the terpenoid solution comprises about 1% to about 5% by volume of the essential oil mixture, about 40% to about 90% by volume of ethanol and about 10% to about 30% by volume of water.

8. The method of claim 1, wherein the smoking herb preparation comprises at least one phytocannabinoid selected from the group consisting of delta-9-tetrahydrocannabinol (THC), cannabidiol (CBD), cannabichromene (CBC), cannabigerol (CBG), tetrandrocannabivarin (THCV), cannabidivarin (SBDV) and cannabinol (CBN).

9. The method of claim 8, wherein the smoking herb preparation comprises a smoking herb other than *cannabis*.

10. The method of claim 1, wherein the terpenoid is derived from a plant other than *cannabis*.

11. The method of claim 1, wherein adding the terpenoid solution comprises applying the terpenoid solution in the liquid state to the smoking herb preparation.

12. The method of claim 11, wherein adding the terpenoid solution comprises dropping droplets of the terpenoid solution onto the smoking herb preparation.

13. The method of claim 11, wherein adding the terpenoid solution comprises at least partially immersing the smoking herb into the terpenoid solution.

14. The method of claim 1, wherein the smoking herb preparation comprises a smoking herb rolled in a rolling paper, and wherein adding the terpenoid comprises impregnating the rolling paper with the terpenoid solution.

15. The method of claim 1, wherein the smoking herb preparation comprises a smoking herb and a rolling sheet, and wherein the method further comprises rolling the smoking herb into cylinder to at least partially confine the smoking herb.

16. The method of claim 1, wherein an amount of the at least one terpenoid added to the smoking herb preparation exceeds a naturally existing amount of *cannabis* terpenoid in the smoking herb by about 10% to about 1000%.

17. A smoking herb preparation system, comprising:

a smoking herb comprising *cannabis;* a terpenoid solution comprising a terpenoid, wherein the terpenoid is selected from the group consisting of pulegone, terpineol-4-ol, p-cymene, borneol, eugenol, sabinene, linalyl acetate, chamazulene, beta-farnesene, benzyl benzoate, benzyl acetate, geraniol, geranyl acetate and combinations thereof; and an applicator for administering a dose of the terpenoid solution to the smoking herb.

18. The system of claim 17, wherein the terpenoid is not naturally occurring in the herb preparation.

19. The system of claim 17, wherein the terpenoid solution comprises an essential oil mixture.

20. The system of claim 19, wherein the essential oil mixture comprises at least one essential oil extracted from the group of plants consisting of *Salvia Sclarea, Pimenta Racemosa, Pistacia Lentiscus, Citrus Limonum*, and combinations thereof.

21. The system of claim 17, wherein the terpenoid solution further comprises a solvent including ethanol and water.

22. The system of claim 17, wherein the applicator comprises a dropper.

23. The system of claim 17, wherein the applicator comprises a sprayer.

24. An herbal smoking blend, comprising:

a smoking herb comprising *cannabis*; and a terpenoid incorporated in the smoking herb at a terpenoid concentration, wherein the terpenoid is not naturally occurring in the smoking herb at the terpenoid concentration, wherein the terpenoid is selected from the group consisting of pulegone, terpineol-4-ol, p-cymene, borneol, eugenol, sabinene, linalyl acetate, chamazulene, beta-farnesene, benzyl benzoate, benzyl acetate, geraniol, geranyl acetate and combinations thereof.

25. The herbal smoking blend of claim 24, wherein the herbal smoking blend comprises at least one essential oil extracted from the group of plants consisting of *Salvia Sclarea, Pimenta Racemosa, Pistacia Lentiscus, Citrus Limonum*, and combinations thereof.

26. The herbal smoking blend of claim 24, wherein the terpenoid is not naturally occurring in the smoking herb.

27. A smoking herb preparation system, comprising:

a smoking herb comprising *cannabis;* a terpenoid solution comprising a terpenoid selected from the group consisting of 1,8-cineole, d-limonene, α-terpineol and combinations thereof; and an applicator for administering a dose of the terpenoid solution to the smoking herb.

* * * * *